United States Patent [19]

Roberts

[11] Patent Number: 4,911,373

[45] Date of Patent: Mar. 27, 1990

[54] TOROIDAL WINCH

[75] Inventor: John E. Roberts, Los Altos, Calif.

[73] Assignee: GTE Government Systems Corporation, Stamford, Conn.

[21] Appl. No.: 342,269

[22] Filed: Apr. 24, 1989

[51] Int. Cl.[4] ..... B65H 75/18

[52] U.S. Cl. ..... 242/54 R; 242/54 A; 242/117; 52/121; 254/374

[58] Field of Search ..... 242/54 R, 54 A, 117; 52/118, 120, 121; 254/374

[56] References Cited

U.S. PATENT DOCUMENTS

| | | | |
|---|---|---|---|
| 3,202,372 | 8/1965 | Meline et al. | 242/54 R |
| 3,728,906 | 4/1973 | Takaki et al. | 242/54 A |
| 4,436,250 | 3/1984 | Becker | 242/54 R |
| 4,520,966 | 6/1985 | Bloch et al. | 242/54 R |

FOREIGN PATENT DOCUMENTS

| | | | |
|---|---|---|---|
| 4715045 | 6/1972 | Japan | 242/54 A |

OTHER PUBLICATIONS

"Custom Torque Motors from Off—the—Shelf Components" by Bjorn M. Karlstrom, *Machine Design,* Jun. 26, 1986, pp. 71–74.

*Primary Examiner*—John M. Jillions

*Attorney, Agent, or Firm*—Douglas M. Gilbert; John F. Lawler

[57] ABSTRACT

A winch having a torodially-shaped drum with an axis of rotation and at least one cable wound on the drum having a cable length extending from the drum parallel to and substantially equally spaced from said axis at all times during rotation of the winch. The drum has negatively-curved and positively-curved surfaces joined at a common edge, the cable being wound on the negatively-curved surface and directed therefrom over the positively-curved surface in a direction parallel to the drum axis. This drum is used advantageously with the mast system described in application Ser. No. 246,112.

7 Claims, 4 Drawing Sheets

TOROIDAL WINCH

BACKGROUND OF THE INVENTION

This invention relates to winches and more particularly to an improved capstan winch useful for extending and retracting telescoping tubes in a mast system of the type described in application Ser. No. 246,112.

The winch described in application Ser. No. 246,112 for extending and retracting the plurality of telescoping tubes comprising the mast includes a motor mounted externally on the mast, a pair of capstans and a plurality of pulleys for directing two pairs of operating cables into the interior of the fixed base mast tube and axially within the mast. This drive arrangement is somewhat bulky and heavy and requires several pulleys for directing the cables between the external motor and the interior of the mast. This invention is directed to an improved winch construction which simplifies the mast system including reduction in the number of pulleys needed.

OBJECTS AND SUMMARY OF THE INVENTION

A general object of the invention is the provision of a simple compact winch for use in extending and retracting a plurality of telescoping tubes in an extendible/retractible mast system.

A further object is the provision of a such a winch which is substantially wholly contained within the mast structure resulting in protection of the winch from the elements.

A more specific object is the provision of such a winch which eliminates the need for several pulleys, thereby reducing the cost of construction and maintenance.

These and other objects of the invention are achieved with a winch having a novel cable drum configuration which enables location of the winch within and under the mast system.

BRIEF DESCRIPTION OF THE DRAWINGS

For a better understanding of the invention as well as other objects and further features thereof, reference is made to the following description which is to be read in conjunction with the accompanying drawings wherein.

DESCRIPTION OF PREFERRED EMBODIMENTS

Figure 2:
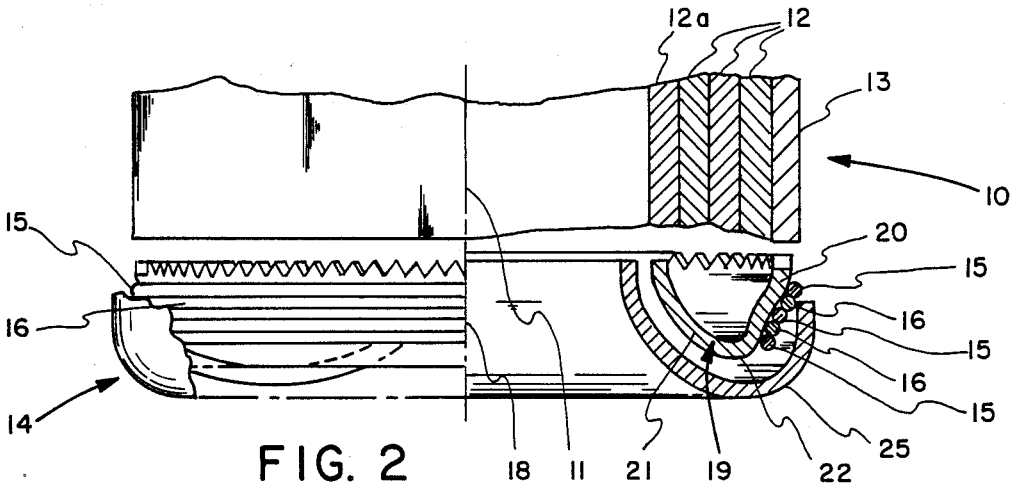
FIG. 2 is a section taken on line 2—2 of FIG. 1 showing the lower part of the mast system.
Figure 1:
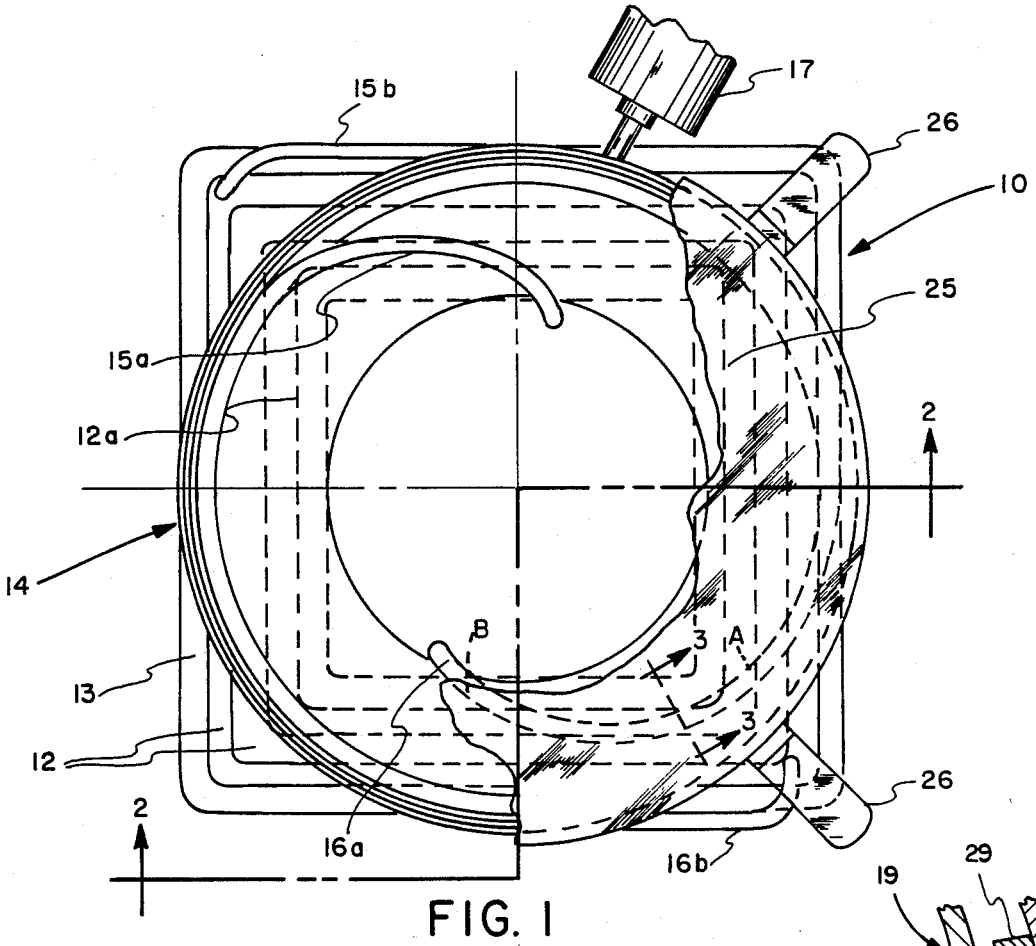
FIG. 1 is a bottom view of an extendible and retractible mast system showing a toroidal winch embodying this invention.

Referring now to the drawings, FIGS. 1 and 2 show the lower part of a mast system 10 having a vertical axis 11 and a plurality of coaxial nested rectangular crosssection tubes 12 that are extendible and retractible within and relative to a fixed base tube 13 by means of a winch 14. The innermost tube. i.e., the one with the smallest transverse dimensions, is designated 12*a*. Cables 15 and 16 extend from winch 14 upwardly as viewed in FIG. 2 for engagement with tube-mounted pulleys, not shown herein but fully described in application Ser. No. 246,112, and return to winch 14. Winch 14 is rotatable by a reversible motor means 17 about an axis 18 coaxial with an extension of mast axis 11 for extending and retracting tubes 12. As winch 14 is rotated in one direction for extending tubes 12, length 15*a* of cable 15 and length 16*a* of cable 16 pay out from the winch to the tube-mounted pulleys and length 15*b* of cable 15 and length 16*b* of cable 16 extend down from the tube-mounted pulleys and are wound tangentially onto winch 14. Reversal of the direction of rotation of the winch has the opposite effect, i.e., retracting extended tubes 12. In short, cables 15 and 16 make a closed loop between and around winch 14 and the cable-mounted pulleys.

Figure 4:
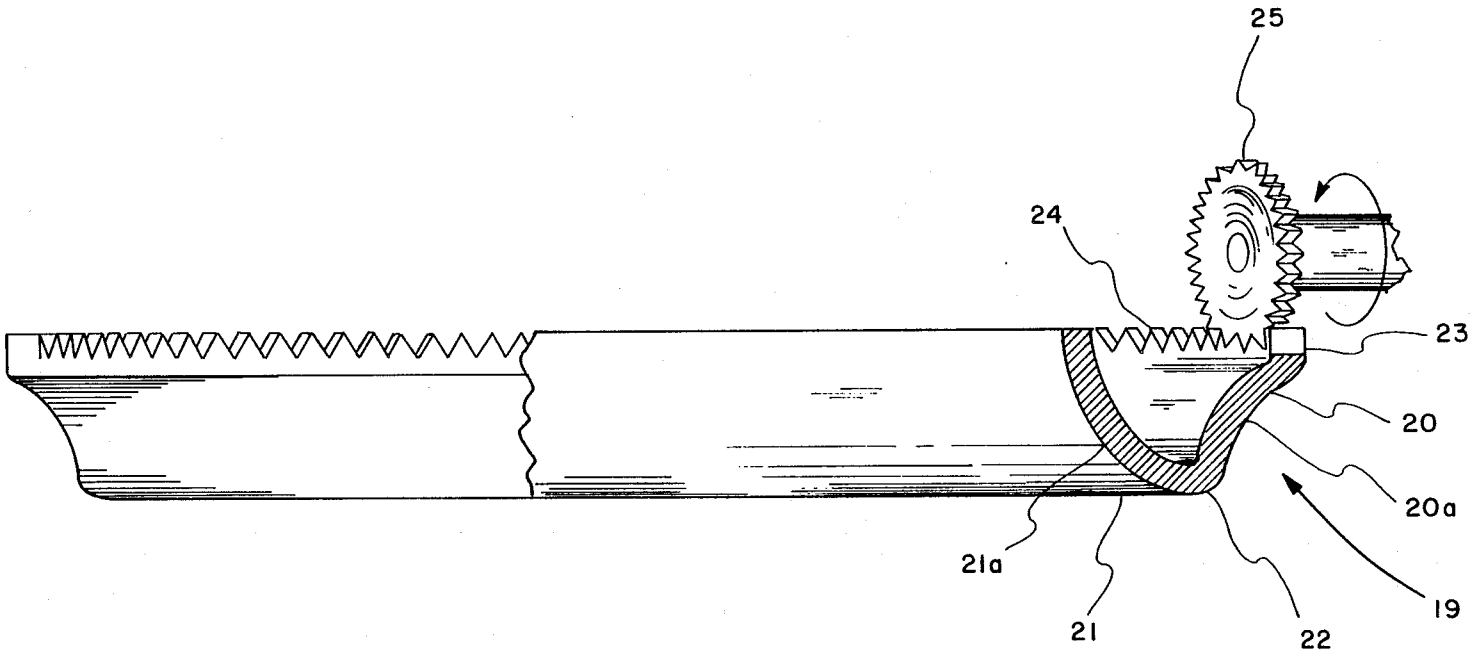
FIG. 4 is an elevation, partly in section, of the toroidal drum part of the winch (without cable) and the gear drive for same.

Winch 14 comprises a capstan drum 19, see FIGS. 2 and 4, having an outer wall 20 with a negatively curved (concave as shown) nearly-vertical outer surface 20*a* and an inner wall 21 with a positively curved (convex as shown) inner surface 21*a*, both surfaces 20*a* and 21*a* converging to and joined at lower rounded edge 22. Thus drum 19 is a toroid. In one embodiment of the invention, outer wall 20 has a flange 23 formed with gear teeth 24 engageable by a spur gear 25 for rotating drum 19 about axis 18. Gear 25 is driven by motor 17.

As shown in FIG. 2, cables 15 and 16 are wrapped in alternating layers around drum surface 20*a*. As drum 19 rotates, for example clockwise as shown in FIG. 1 to extend tubes 12, each of cables 15 and 16 moves down on drum surface 20*a*, over bottom drum edge 22 and up over inner surface 21*a* into the interior of innermost tube 12*a* for engagement with the tube mounted pulleys. Conversely, when the rotation of drum 19 is reversed, i.e., in a counterclockwise direction as shown in FIG. 1 to contract tubes 12, cables 15 and 16 are pulled down from the pulley mounted on innermost tube 12*a*, over inner drum surface 21*a* and drum edge 22, around outer drum surface 20*a* and tangentially off the latter for return to the tube-mounted pulleys. In addition to providing an operative mast extending and contracting connection between winch 14 and tubes 12, cables 15 and 16 also function to support winch 14 against the bottom of base tube 13.

Figure 3:
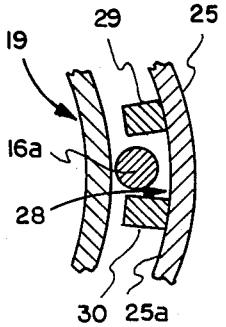
FIG. 3 is an enlarged section taken on line 3—3 of FIG. 1.

In order to direct cables 15 and 16 between the interior of innermost tube 12*a* and drum 19, a cover 25 fastened to base tube 13 by four brackets, two of which are shown at 26, extends over and close to drum 19. Cover 25 has two diametrically opposite identical curved cable guideways on the inside thereof for cables 15 and 16, respectively, one of which guideways is shown at 28 in FIG. 3. Each guideway 28 is formed by curved strips 29 and 30 secured to and projecting from inner surface 25*a* of cover 25 as shown and curved upwardly so as to direct the cables off drum 19 at predetermined angular points for passage into innermost tube 12*a*. The length of each guideway 28 insures a smooth change in direction of the cable between drum 19 and tube 12*a* and extends, for example, from point A to point B, see FIG. 1. As drum 19 rotates, for example, in a clockwise direction as viewed in FIG. 1 to extend mast tubes 12, cable lengths 15*a* and 16*a* pass through the respective guideways 28 and are thus directed from drum surface 21*a* at the desired angular locations thereon into innermost tube 12*a*. Conversely, during retraction of the extended mast tubes 12, drum 19 is rotated in a counterclockwise direction as viewed and cable lengths 15*a* and 16*a* are pulled down and onto drum 19 through guideways 28.

Figure 5:
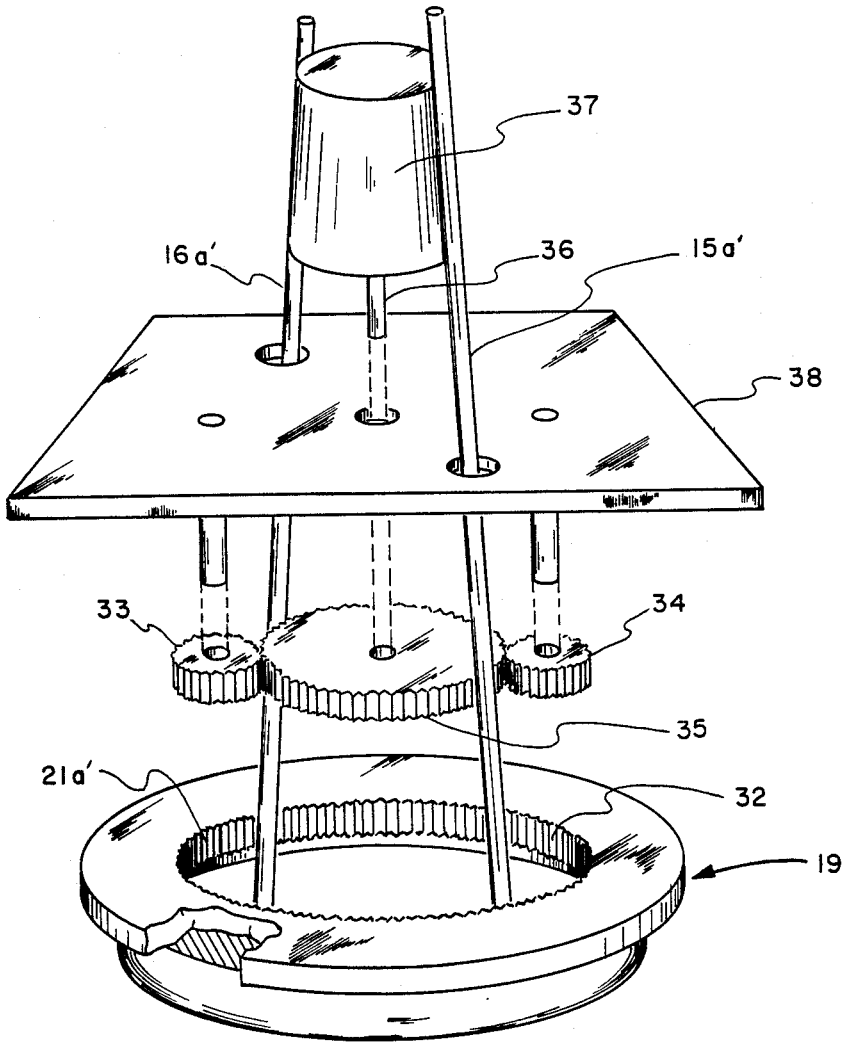
FIG. 5 is a perspective exploded view of a modified form of the invention with a planetary gear drive for the drum.

Another embodiment of the invention shown in FIG. 5 features an alternate drum drive arrangement in which a drum 19' is similar to drum 19 except that gear teeth 32 are formed on the upper part of the inner surface 21*a'* of drum 19', like parts being indicated on the drawings by the primes of like reference characters. Drum teeth 32 are adapted to be engaged by planetary gears 33 and 34 driven by an intermediate sun gear 35 which is rotated by drive shaft 36 of motor 37. Motor 37 and planetary gears 33 and 34 are supported on base tube 13 by means of a spider plate 38 provided with appropriate openings for the passage therethrough of cable lengths 15*a'* and 16*a'* and motor shaft 36. This drive arrangement advantageously permits motor 37 to be housed within the mast thereby providing protection from the elements and also resulting in a more compact assembly.

Figure 6:
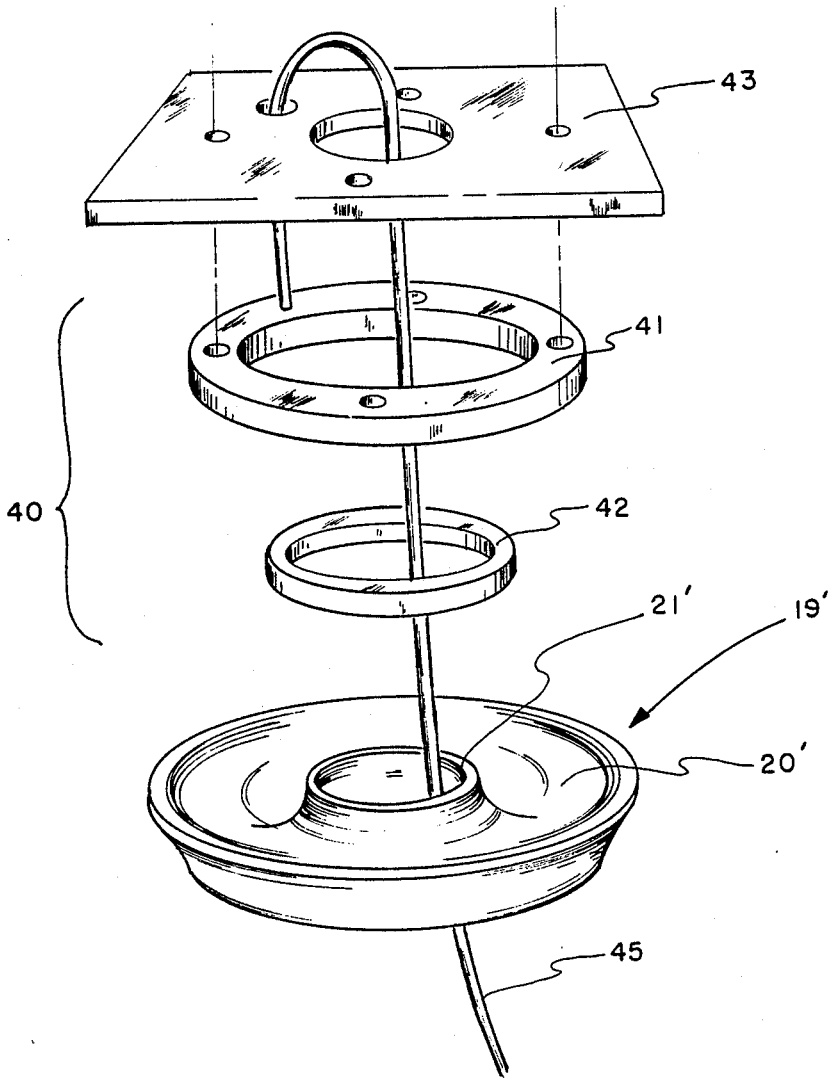
FIG. 6 is a perspective exploded view of another form of the invention with a ring motor drive for the drum.

Still another embodiment of the invention is shown in FIG. 6 in which a different compact drive motor is employed to rotate drum 19, like parts being indicated by the primes of like reference characters on the drawings. The motor employed in this embodiment is a ring model of the type described in detail in an article entitled "CUSTOM TORQUE MOTORS FROM OFF-THE-SHELF COMPONENTS" by Bjorn M. Karlstrom published in Machine Design, June 26, 1986, pages 71 to 74. As shown in FIG. 6, ring motor 40 comprises an annular stator 41 mounted on base mast tube 13 and an annular rotor 42 secured to drum 19 and adapted to fit coaxially within stator 41. More specifically, rotor 42 is disposed between and coaxially of outer drum wall 20' and inner drum wall 21' and is secured to the latter. Stator 41 is likewise disposed between drum walls 20' and 21' and is supported by spider 43 on base tube 13. An external power line 45 is fed through central openings in the parts for connection to stator 41. This embodiment has the additional advantage over the embodiment of FIG. 5 in that it is even more compact.

What is claimed is:

1. A toroidal winch comprising:

an annular drum having an axis and first and second walls joined together along a common edge and diverging therefrom, said walls having respective edges opposite from said common edge and differently radially spaced from said axis;

said first wall having a concavely curved toroidal surface facing outwardly from said axis;

said second wall having a convexly curved toroidal surface facing inwardly toward said axis;

cable means fed tangentially to and wound coaxially a plurality of times around said concave surface of said first wall and defining a like plurality of wraps therearound between said common and opposite edges thereof;

said cable means extending over said common edge and said convex surface of said second wall generally co-directionally with said axis; and means for rotating said drum about said axis whereby to move said cable between directions tangentially and coaxially of said drum.

2. The winch according to claim 1 in combination with a mast system comprising a fixed base tube and a plurality of telescoping tubes disposed coaxially within and extendible from and retractible into one end of said base tube, said drum being disposed adjacent to the end of said base tube opposite said one end thereof, said cable means extending from said drum being operatively connected to said tubes.

3. The combination according to claim 2 with a cover supported on said base tube adjacent to and spaced from said drum, said cover having cable guideway means through which said cable means passes for directing said cable means between said drum and said tubes at predetermined angular locations on said drum.

4. The winch according to claim 1 in which said last named means comprises gear teeth on said opposite edge of said first wall, gear means engaging said teeth, and motor means for rotating said gear means.

5. The winch according to claim 1 in which said last named means comprises a ring gear connected to said opposite edge of said second wall, planet gear means engaging said ring gear, and motor means operatively connected to said planet gear means.

6. The winch according to claim 5 in which said motor means comprises an annular stator and an annular rotor coaxially disposed between said first and second walls of said drum.

7. The winch according to claim 1 with non-rotatable support means adjacent to said drum and in which said drum rotating means comprises a ring motor having an annular stator and an annular rotor, said rotor being coaxially secured to said drum, said stator being secured to said support means coaxially of said rotor, and means for electrically energizing said stator.

* * * * *